US012501977B2

(12) United States Patent
Skoboleva

(10) Patent No.: US 12,501,977 B2
(45) Date of Patent: Dec. 23, 2025

(54) BAG WITH ADJUSTABLE PANELS

(71) Applicant: Sharon Skoboleva, Parlin, NJ (US)

(72) Inventor: Sharon Skoboleva, Parlin, NJ (US)

( * ) Notice: Subject to any disclaimer, the term of this patent is extended or adjusted under 35 U.S.C. 154(b) by 99 days.

(21) Appl. No.: 18/745,633

(22) Filed: Jun. 17, 2024

(65) Prior Publication Data

US 2025/0380779 A1 Dec. 18, 2025

(51) Int. Cl.
*A45C 13/02* (2006.01)
*A45C 13/10* (2006.01)

(52) U.S. Cl.
CPC ..... *A45C 13/02* (2013.01); *A45C 13/1092* (2013.01); *A45C 2013/026* (2013.01)

(58) Field of Classification Search
CPC ..... A45C 13/02; A45C 13/1092; A45C 2013/026
USPC ..... 190/110
See application file for complete search history.

(56) References Cited

U.S. PATENT DOCUMENTS 1,891,025 A 12/1932 Luttmann
2,440,192 A * 4/1948 Cowan ..... A47G 25/54 211/149
2,628,694 A 2/1953 Kushner
5,090,526 A * 2/1992 Jacober ..... A45C 7/0077 383/110
5,678,666 A * 10/1997 Shyr ..... A45C 5/14 190/110
6,508,358 B2 1/2003 Cheng
6,910,560 B2 6/2005 Dulin
7,984,820 B2 7/2011 Dancyger
8,011,484 B2 9/2011 McIntyre
9,259,082 B2 * 2/2016 Barre ..... A47F 5/0892
9,801,444 B2 10/2017 Watson
11,666,134 B2 6/2023 Cole et al.
2002/0038745 A1 4/2002 Lamming
2007/0235490 A1 * 10/2007 Katz ..... A45F 4/00 224/644
2013/0043293 A1 * 2/2013 Connell ..... A45C 13/02 224/652
2018/0168306 A1 * 6/2018 Shyr ..... A45C 5/14

OTHER PUBLICATIONS

No Reception Club "The Getaway Bag", accessed Jun. 19, 2024, https://noreceptionclub.com/products/backpack-getaway.

(Continued)

*Primary Examiner* — Don M Anderson
*Assistant Examiner* — Justin Caudill
(74) *Attorney, Agent, or Firm* — Douglas R. Smith, Esq.; Harter Secrest & Emery LLP

(57) ABSTRACT

A bag system including a bag, a first set of straps secured to a first interior surface of the bag, a second set of straps secured to a second interior surface of the bag, and a panel received within the bag. The first panel has first fold line proximate a first end to define a first fold portion and a second fold line proximate a second end to define a second fold portion, and a panel portion defined therebetween. The first fold portion passes between the first interior surface and a strap of the first set of straps with the first end of the panel being releasably secured to the panel portion. The second fold portion passes between the second interior surface and a strap of the second set of straps with the second end of the panel being releasably secured to the panel portion to subdivide the bag interior.

12 Claims, 7 Drawing Sheets

(56) References Cited

OTHER PUBLICATIONS

No Reception Club "The Hideaway Carry-On Duffel", accessed Jun. 19, 2024, https://noreceptionclub.com/products/the-hideaway-carry-on-duffel.

* cited by examiner

BAG WITH ADJUSTABLE PANELS

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present disclosure relates to bags, including but not limited to handbags, shoulder bags, tote bags, backpacks, duffels, briefcases, and luggage; and more particularly to a bag including an inner compartment configured to be selectively subdivided into smaller inner sub-compartments; and still more particularly to a bag including a system of adjustable panels to selectively subdivide the inner compartment.

Description of Related Art

Current commercially available bags are limited in their utility as the configuration of the carrying space is predetermined at the time of manufacture. While alternative bags do allow for some customization of the inner compartment, these alternative systems still suffer a number of drawbacks. For instance, bags including zippered tracks with matching zippered panels may enable modification of the inner dimensions of the bag. However, these zippers may significantly add to the cost of bag, as well as add unwanted weight to the finished product. Alternatively, a bag interior wall and associated adjustable panels may be provided with complimentary hook-and-loop materials whereby the panels can "stick" to the inner wall of the bag to subdivide the inner compartment. While promoting a wide range of sub-divisible layouts, the hook-and-loop materials may interfere with, or catch upon, the goods being placed within the bag, such as clothes or other textiles.

Thus, what is needed is a bag and panel system, and optionally, one or more associated accessories, which promotes inner compartment customization and organization without suffering the drawbacks of the current art. The present invention addresses these, as well as other, needs.

BRIEF SUMMARY OF THE INVENTION

It is, therefore, an aspect of the present disclosure to provide a bag system comprising a bag, a first set of straps, a second set of straps and a first panel. The bag includes a top wall, a bottom wall opposing the top wall, a first side wall and a second side wall opposing the first side wall, and a back wall attached to each of the top wall, bottom wall, first side wall, and second side wall. The bag defines an inner compartment and further includes a front wall adapted to selectively open and close the inner compartment. The first set of straps is secured to an inner surface of the first side wall and the second set of straps is secured to an interior surface of the second side wall and the second set of straps opposes the first set of straps. The first panel has a first end and an opposing second end. A first fold line is located proximate the first end to define a first fold portion between the first end and the first fold line. A second fold line is located proximate the second end to define a second fold portion between the second end and the second fold line. A panel portion is then defined between the first fold line and the second fold line.

The first panel is configured to be received within the inner compartment so that the panel portion extends between the interior surface of the first side wall and the interior surface of the second side wall. The first fold portion is configured to pass between the interior surface of the first side wall and a respective strap of the first set of straps. The first fold portion is then releasably secured to the panel portion. The second fold portion is configured to pass between the interior surface of the second side wall and a respective strap of the second set of straps which is opposed to the respective strap of the first set of straps. The second fold portion is ten releasably secured to the panel portion. The first panel subdivides the inner compartment into a first subdivided compartment and a second subdivided compartment.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Figure 1:
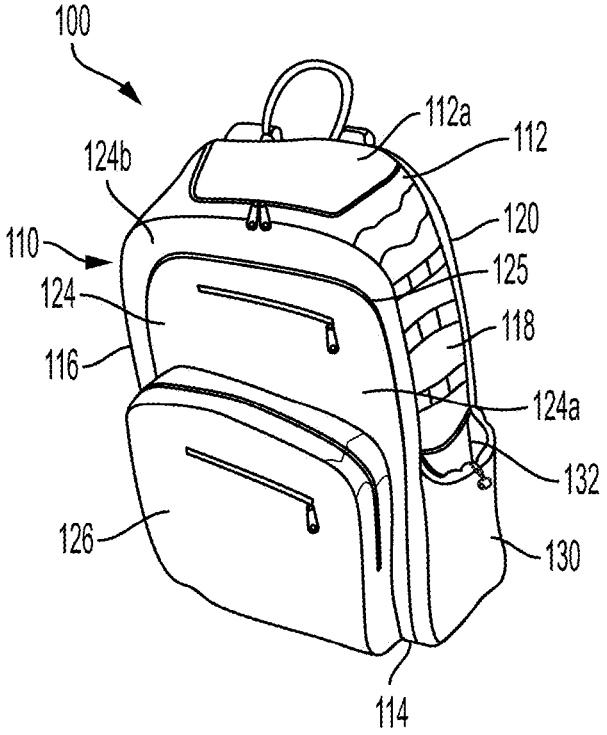
FIG. 1 is a front perspective view of an exemplary embodiment of bag suitable for use with a bag system in accordance with the present invention.
Figure 2:
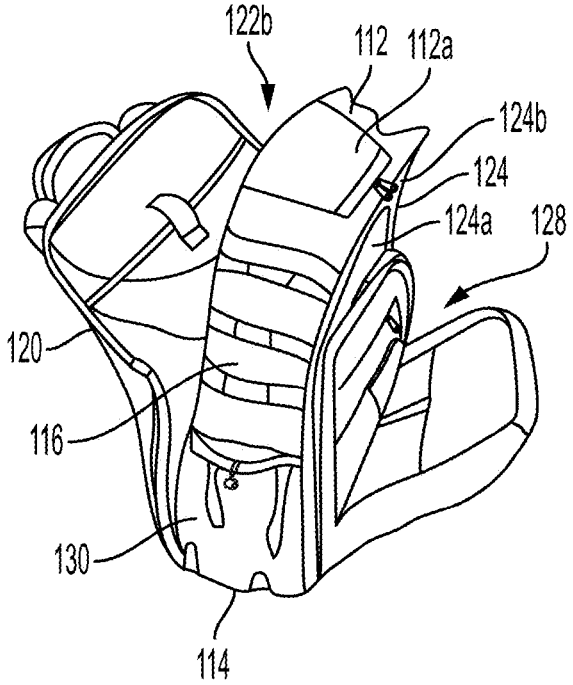
FIG. 2 is a side perspective view of the exemplary bag shown in FIG. 1 with optional rear and front pockets being shown.
Figure 3:
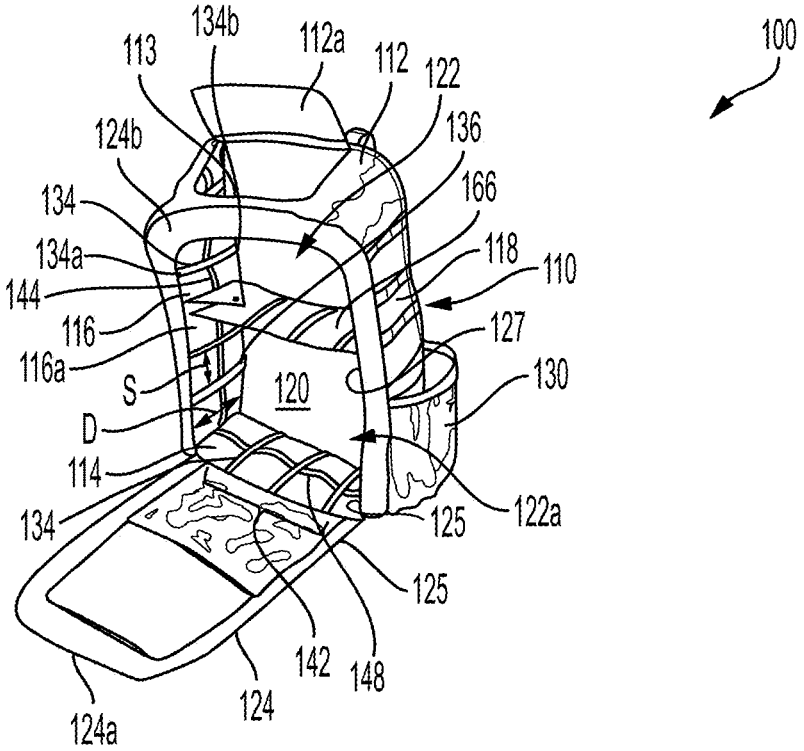
FIG. 3 is a front perspective view of the exemplary bag shown in FIG. 1 with the front wall opened to show the inner compartment of the bag.

With reference to the drawings, and in particular to FIGS. 1-3, an exemplary embodiment of bag system 100 is shown. While exemplary bag system 100 is depicted generally as a backpack style bag, those skilled in the art should understand that any suitable type of bag may be used in accordance with the following discussion, including without limitation, bags such as handbags, shoulder bags, tote bags, duffels, briefcases, luggage, and the like. As shown, bag system 100 may generally include a bag 110 having a top wall 112, bottom wall 114, first side wall 116 and second side wall 118. Bag 110 may further include a back wall 120 attached to each of top wall 112, bottom wall 114, first side wall 116 and second side wall 118 to define an open inner compartment 122. At least a portion 124*a* of front wall 124 may be adapted to selectively open and close bag 100 to permit access to inner compartment 122. By way of example and without limitation thereto, front wall portion 124*a* may be fixedly secured to a single wall, e.g., bottom wall 114 while being releasably secured to the fixed portion 124*b* of front wall 124 using a fastener 125, such as a zipper, snaps, buttons, hook-and-loop fastener, and the like to define a compartment opening 127. Optionally as shown, a portion 112*a* of top wall 112 may also be configured as a flap to define a top opening 113 that can be selectively opened or closed to allow access to open inner compartment 122 from the top of bag 110.

Bag 110 may also include one or more additional walls, such as a fixed interior wall panel which may create predefined one or more sub-compartments within open interior compartment 122. By way of example and without limitation, an additional inner panel (not shown) may be included between back wall 120 and front wall 124 to segregate inner compartment 122 into a main compartment 122*a* and a secondary compartment 122*b*. The additional inner panel may include padding material whereby the secondary compartment may be cushioned so as to receive fragile materials, such as a laptop computer, tablet, or other electronic device therein. Additionally or alternatively, additional walls may be formed along the outer periphery of bag 110, such as front pocket wall 126 which may form a front pocket compartment 128 in conjunction with front wall 124, or one or more partial side wall(s) 130 which may form an open pouch 132 in conjunction with first side wall 116 (and/or second side wall 118).

With particular reference to FIG. 3, inner compartment 122/main compartment 122*a* of bag 110 may include a plurality of mounting members 134, such as straps or loops, fixedly attached to first and second side wall 116, 118, and optionally, bottom wall 114. By way of example and without limitation thereto, mounting members 134 may be comprised of a rugged fabric, such as grosgrain fabric, ribbon, or tape and may be of any desirable width, such as between about one inch and one-eighth inch wide, and more preferably between about one-quarter and one-half inch wide.

As shown in FIG. 3, a first set 136 of mounting members 134 may be affixed along inner surface 116*a* of first side wall 116. By way of example, a first end 134*a* of each mounting member 134 may be located within, such as by being stitched into, main compartment 122*a* at or proximate to the junction between first side wall 116 and front wall 124 while a second end 134*b* may be located within (stitched into) main compartment 122*a* (or inner compartment 122) at or proximate to the junction between first side wall 116 and the inner panel (or back wall 120), so as to form an open loop-like structure in combination with inner surface 116*a*. A second set 138 of mounting members 134 may be affixed along inner surface 118*a* of second side wall 118 (see FIG. 14). In an exemplary embodiment, the first and second sets 136, 138 of mounting members 134 are configured to be disposed directly opposite one another so as to releasably secure one or more panels 166 within main/inner compartment 122*a*/122, as will be described in greater detail below.

Figure 4:
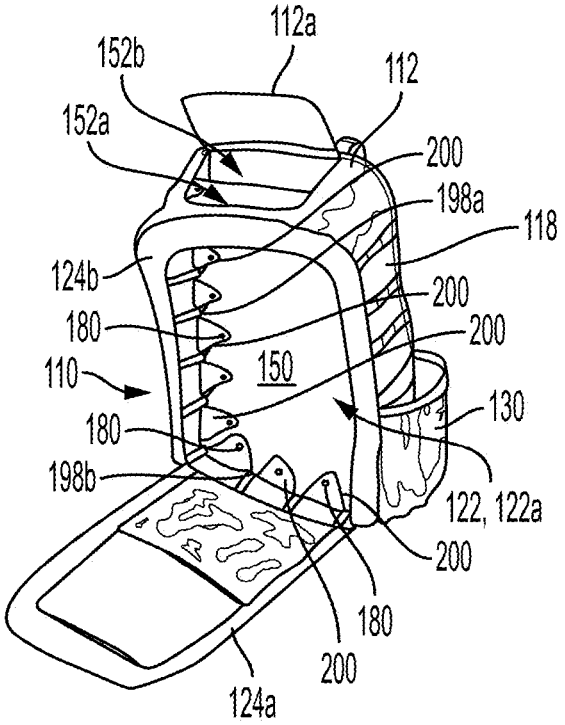
FIG. 4 is a front perspective view of the exemplary bag shown in FIG. 1 showing an exemplary embodiment of the bag system including a divider panel removably secured within the bag.

With continued reference to FIG. 3, optionally, a third set 142 of mounting members 134 may be located within (stitched into) main compartment 122*a* (or inner compartment 122) along the inner surface 114*a* of bottom wall 114. As further seen in FIG. 3, first side wall 116 may include an additional first longitudinal strap 144 medially located on inner surface 116*a*. In one aspect, first longitudinal strap 144 is positioned between inner surface 116*a* and the first set 136 of mounting member 134. Second side wall 118 may similarly include a second longitudinal strap 146 (see, e.g., FIG. 6), while bottom wall 114 includes a third longitudinal strap 148. With reference to FIG. 4, longitudinal straps 144, 146, 148 may be configured to releasably mount a divider panel 150 within main compartment 122*a*/inner compartment 122 to bisect main compartment 122*a*/inner compartment 122 into a forward subdivided compartment 152*a* and a rear subdivided compartment 152*b* which may be accessible via top opening 113.

Figure 5:
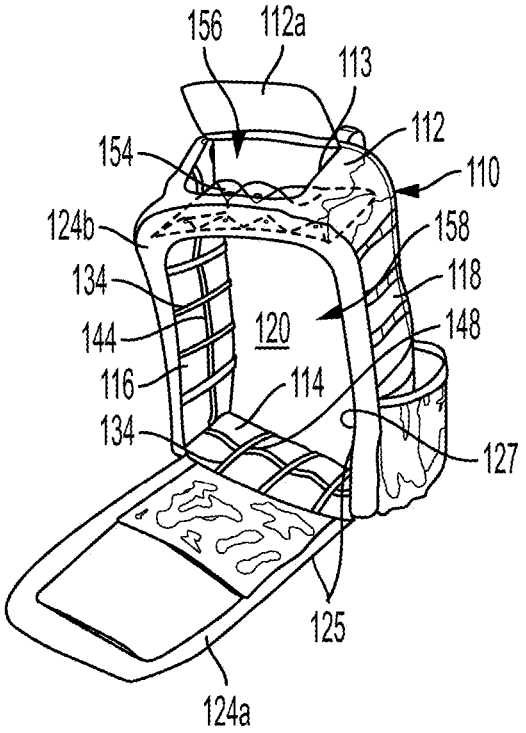
FIG. 5 is a front perspective view of the exemplary bag shown in FIG. 1 showing an exemplary embodiment of the bag system including a top pocket panel removably secured within the bag.
Figure 6:
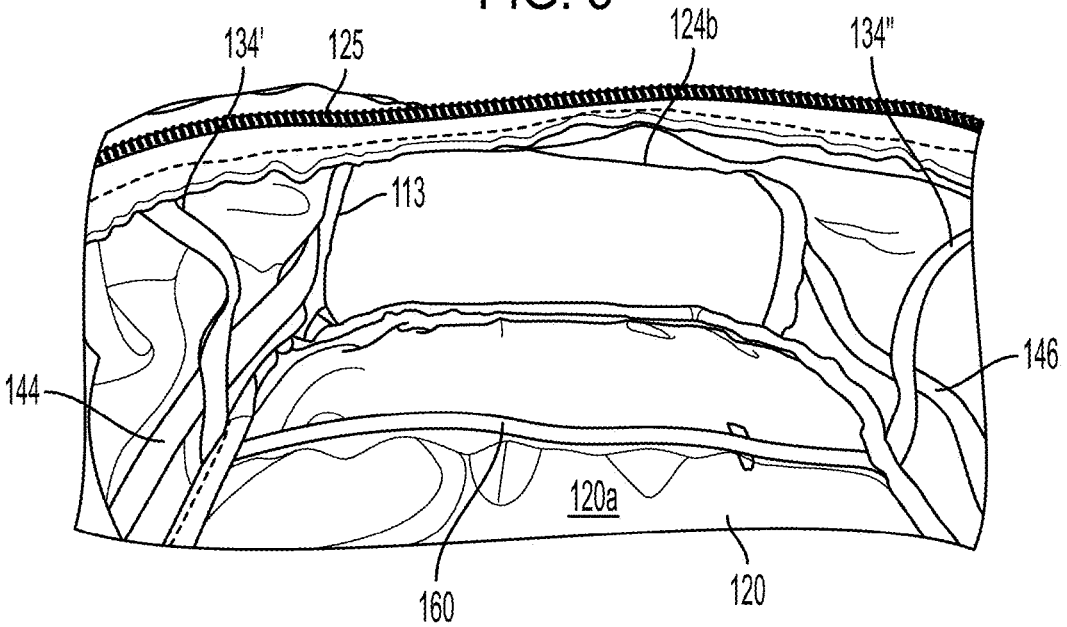
FIG. 6 is an expanded internal view showing an exemplary mounting system for the top pocket panel shown in FIG. 5.

Turning now to FIGS. 5 and 6, bag 110 may be configured to removably receive a top pocket panel 154 so as to divide inner compartment 122 into a top pocket 156 accessible only through top opening 113 defined by flap portion 112*a* of top wall 112, and a lower compartment 158 accessible through compartment opening 127 defined by front wall panel 124*a* and front wall fixed portion 124*b*. As shown in FIG. 6, inner surface 120*a* of rear wall 120 may be configured to include a first lateral strap 160 while front wall 124 fixed portion 124*b* includes a corresponding second lateral strap 162 (see FIG. 12). The second lateral strap may be fixedly secured to the inner surface of fixed portion 124*b* proximate to fastener 125. Respective mounting members 134' and 134" of first and second sets 136, 138 may be arranged such that first and second lateral straps 160, 162 and mounting members 134' and 134" are coplanar. Thus, in one exemplary embodiment, top pocket 156 may lie generally parallel with bottom wall 114 when mounted to first and second lateral straps 160, 162 and mounting members 134' and 134", as will be described in greater detail below.

Figure 7:
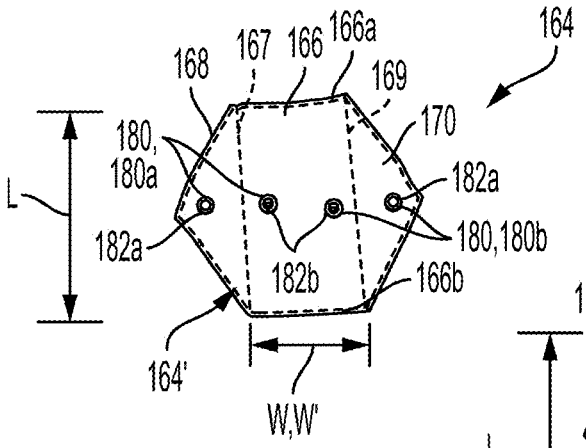
FIG. 7 is an exemplary embodiment of an interchangeable panel configured for use within the bag system shown in FIG. 3.
Figure 8:
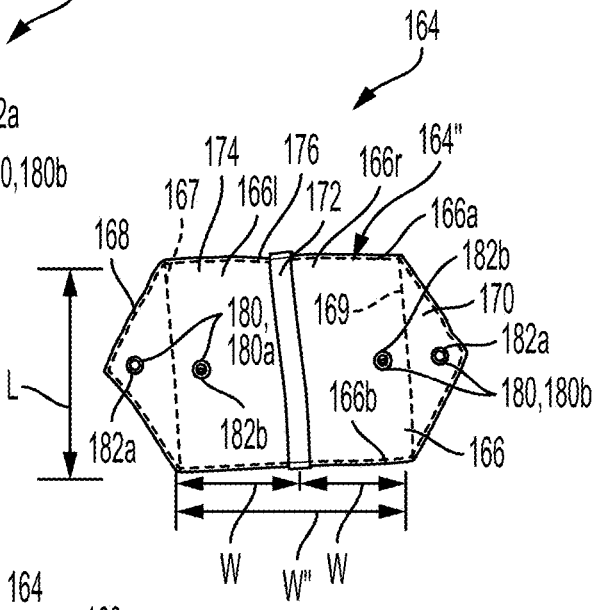
FIG. 8 is another exemplary embodiment of an interchangeable panel configured for use within the bag system shown in FIG. 3.
Figure 9:
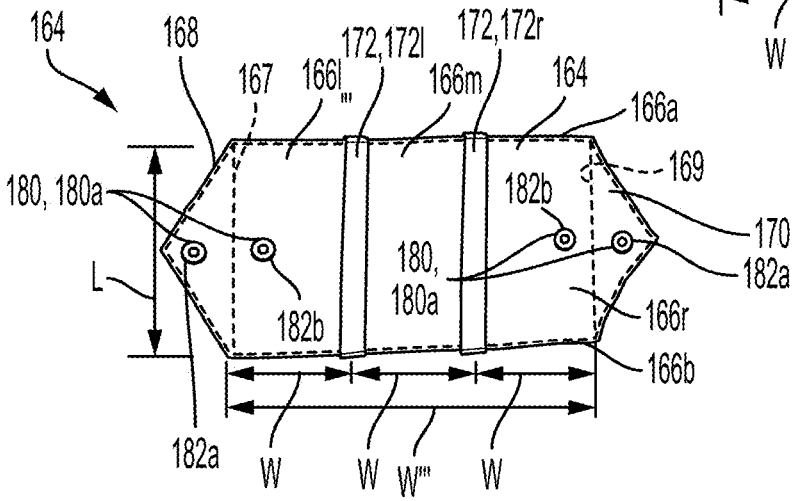
FIG. 9 is still another exemplary embodiment of an interchangeable panel configured for use within the bag system shown in FIG. 3.
Figure 10:
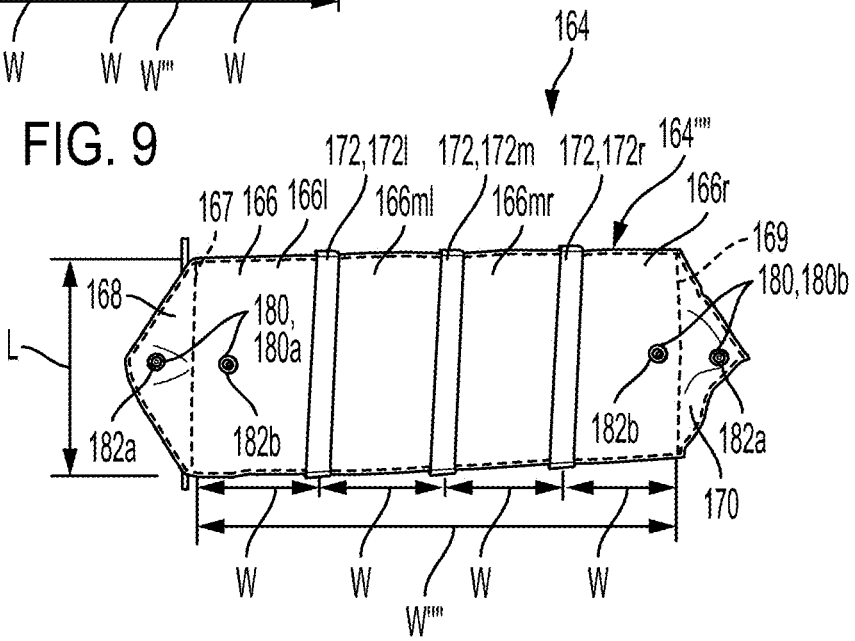
FIG. 10 is yet another exemplary embodiment of an interchangeable panel configured for use within the bag system shown in FIG. 3.

With reference to FIGS. 7-10, in an exemplary embodiment, bag system 100 may include a plurality of interchangeable panels 164 which are configured to subdivide inner compartment 122 into two or more subdivided compartments having user-selected dimensions, which will be discussed in greater detail below with regard to FIG. 14. As generally shown in FIG. 7, each interchangeably panel 164 comprises a central wall portion 166 bounded along one side with a first fold portion 168 and the opposing side with a second fold portion 170. Fold lines 167 and 169 may be included to assist folding of first fold portion 168 and second fold portion 170, respectively, relative to central wall portion 166. Central wall portion 166 may have a width W comprised of the material webbing between fold lines 167, 169; and a length L comprised of the material webbing between top edge 166*a* and bottom edge 166*b*. Width W may be selected to be substantially the same as (or a multiple of) the spaced distance S between successive mounting member 134, while length L may be selected to be substantially the same as depth D of inner compartment 122/main compartment 122*a* (see FIG. 3). Fold portions 168, 170 may be of any planar shape, but may be tapered either through an arcuate or angled line, and as shown, with angled lines that intersect to form a generally triangular-shaped fold portion so as to aid in mounting of panel 164, as will be described below. Each panel 164 may be fabricated of a smooth fabric, such as woven nylon, to minimize interference with goods (particularly textiles) being placed within or taken out of bag 110. Each panel 164 may also have a rigid, yet flexible, central wall portion 166 core, such as but not limited to a cardboard, a plastic, and more preferably, a foam material.

As shown in FIG. 7, panel 164' has a width W' which equals width W and is substantially equal to spaced distance S. Panel 164" shown in FIG. 8 has a width W" which is twice that of width W (e.g. 2×W). Strap or loop 172 may then be located substantially equidistant between fold lines 167 and 169 such that panel 164" may then be bisected into two wall sub-portions 166*l*, 166*r*, wherein each sub-portion 166*l*, 166*r* has a nominal width substantially equal to width W. Strap/loop 172 may traverse one of, or more preferably both of, front face 174 and or rear face 176 of panel 164". Strap/loop 172 may also be fixedly secured to panel 164" proximate top edge 166*a* and bottom edge 166*b*. Similarly, panel 164''' shown in FIG. 9 has a width W''' which is three times that of width W (e.g., 3×W) and include two straps/loops 172*l*, 172*r* trisecting width W''' into three sub-portions 166*l*, 166*m*, 166*r* each having a nominal width W; while panel 164'''' shown in FIG. 10 has a width W'''' which is four times that of width W (e.g., 4×W) and include three straps/loops 172*l*, 172*m*, 172*r* quadrisecting width W''' into four sub-portions 166*l*, 166*ml*, 166*mr*, 166*r* each having a nominal width W. It should be noted that panels 164 may be of any desired length and width, and may be adapted, such as, depending upon the type of bag being used and selectively sub-compartmented in accordance with the present invention. It should also be noted that additional straps/loops may be placed at intermediate locations between fold lines 167, 196 and/or any straps 172 such that these additional straps further divide sub-portions 166 into panel sub-portions having widths less than width W.

As further shown in FIGS. 7-10 each interchangeable panel 164 includes a pair of fasteners 180. In one non-limiting example, each fastener may comprise complementary fastener halves 180*a*, 180*b* which are configured to matingly engage one another so as to fasten together. By way of example, fastener halves 182*a*, 182*b* may be a snap fastener comprising a male half 182*a* and a female half 182*b*. A first fastener 180*a* of the pair of fasteners 180 may include male half 182*a* located on first fold portion 168 or panel wall portion 166 proximate fold line 167 while female half 182*b* is located at the other of first fold portion 168 or panel wall portion 166 proximate fold line 167. A second fastener 180*b* of the pair of fasteners 180 may include male half 182*a* located on second fold portion 170 or panel wall portion 166 proximate fold line 169 while female half 182*b* is located at the other of second fold portion 170 or panel wall portion 166 proximate fold line 169. While shown and described as snap fasteners, any suitable fastener may be used, such as buttons. The use of hook-and-loop fasteners is discouraged for embodiments which are intended for use with textiles, such as diaper bags, as the hook-and-loop material may engage with or interfere with the textiles which may damage the textiles, prevent proper engagement of the hook and loop halves from fastening, or otherwise lead to user frustration.

Figure 14:
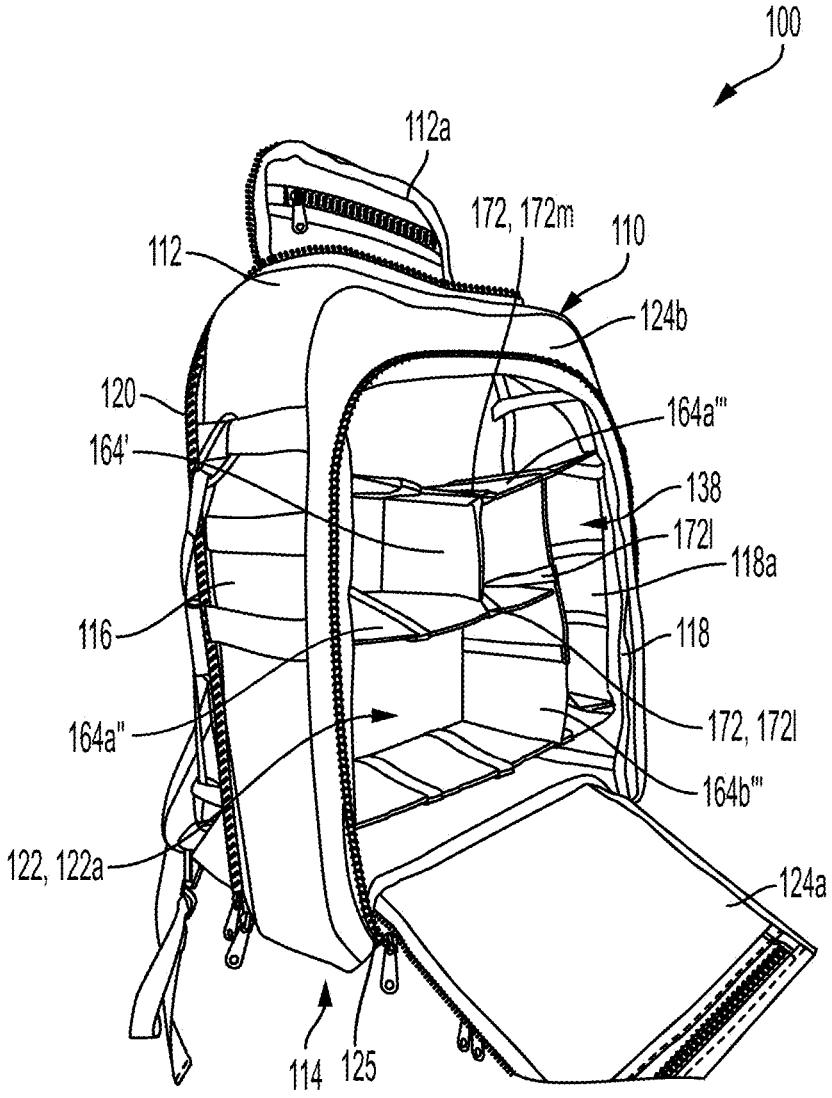
FIG. 14 is a front perspective view of the exemplary embodiment of the bag shown in FIG. 1 with the bag in an open configuration and including an exemplary embodiment of the interchangeable panels of the bag system in accordance with the present invention.

With additional reference to FIGS. 3 and 14, to mount an interchangeable panel 164 within inner compartment 122/main compartment 122*a*, first fold portion 168 passes between a desired mounting member 134 and its respective inner side wall surface 116*a* or 118*a*. First fold portion 168 is the folded similar to an envelope fold at fold line 167 whereby fasteners halves 182*a*, 182*b* of first fastener 180*a* align with one another such that the two halves may be releasably secured (e.g., snapped) together with central wall portion 166 (along fold line 167) adjacent inner side wall surface 116*a* or 118*a*. In the example illustrated in FIG. 3, opposing second fold portion 170 may similarly pass between the other of inner side wall surface 116*a* or 118*a* whereby second fastener 180*b* is snapped together such that central wall portion 166 (along fold line 169) is adjacent the other of inner side wall surface 116*a* or 118*a*. In this manner, interchangeable panel (e.g., panel 164'''') may span the entire width W of inner compartment 122/main compartment 122*a*.

Additionally or alternatively and as best shown in FIG. 14, one or more interchangeable panels 164 (e.g., panel 164*a*'''') may have its respective first fold portion 168 releasably secured to inner side wall surface 116*a* or 118*a* as described above. However, rather than have its second fold portion 170 secured to the other of inner side wall surface 116*a* or 118*a*, second fold portion 170 of panel 164*a*''' may be secured to a strap/loop 172 of a second interchangeable panel (e.g., strap loop 172*l* of panel 164*b*'''). Similarly, one or more interchangeable panels 164 (e.g., panel 164') may have its respective first fold portion 168 releasably secured to a strap/loop 172 of a first interchangeable panel (e.g., strap/loop 172*m* of panel 164*a*''''') and its opposing second fold portion 170 secured to a strap/loop 172 of a second interchangeable panel (e.g., strap/loop 172*r* of panel 164*a*'''). Thus, as shown more clearly in FIG. 14, bag system 100 may be fully customizable by a user to create a bag 110 having an inner compartment 122/main compartment 122*a* subdivided into a plurality of interchangeable sub-compartments depending upon the user's needs or desires.

Figure 11:
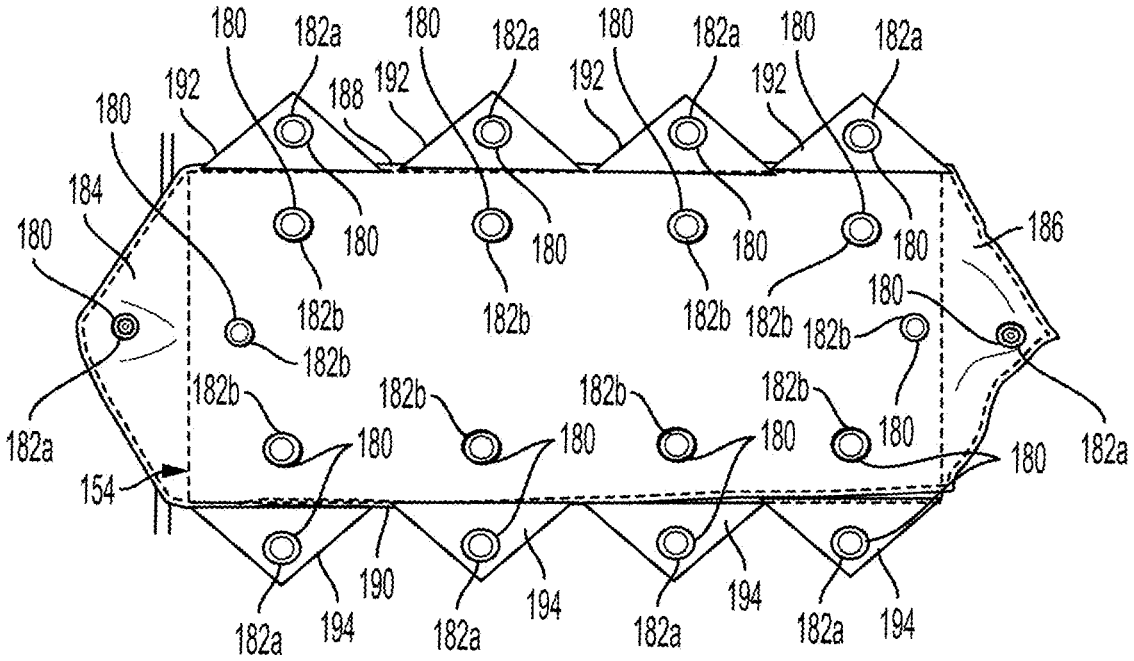
FIG. 11 is a top plan view of an exemplary top pocket panel for use within the bag system shown in FIG. 5.
Figure 12:
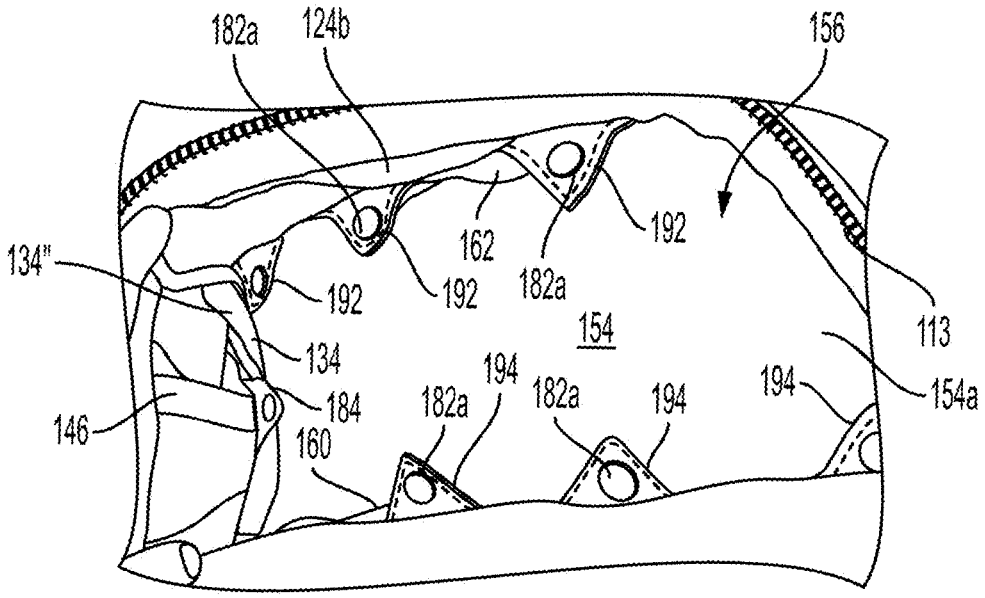
FIG. 12 is a top view of the exemplary top pocket panel shown in FIG. 11 as mounted within the bag system shown in FIG. 5.
Figure 13:
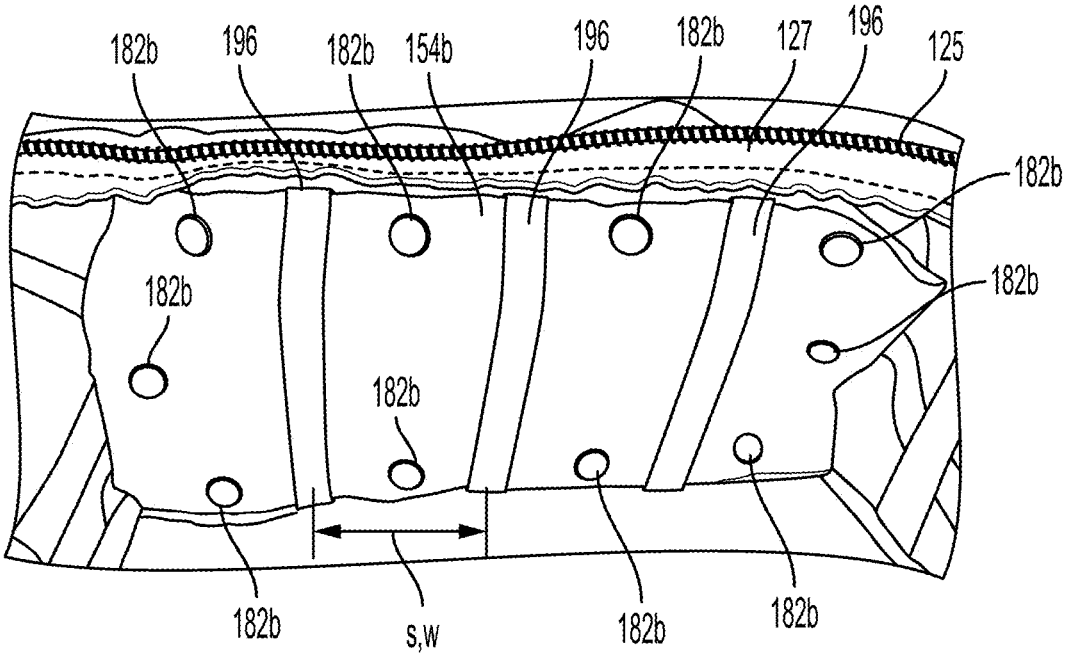
FIG. 13 is a bottom view of the exemplary top pocket panel shown in FIG. 11 as mounted within the bag system shown in FIG. 5.

Turning now to FIGS. 11-13, top pocket panel 154 (FIG. 11) is secured within bag 110, with FIG. 12 showing a bottom view of top pocket panel 154 taken from compartment opening 127 (see FIG. 5) while FIG. 13 shows a top view of top pocket panel 154 through top opening 113. As seen in FIG. 11, top pocket panel 154 is similar to panel 164'''' (see FIG. 10), with a few notable differences. Like panel 164'''', top pocket panel 154 includes opposing first and second fold portions 184, 186 (analogous to first and second fold portions 168, 170) which are configured to be received within and fasten around mounting members 134', 134" as described above with regard to FIG. 3.

However, unlike panel 164"", top pocket panel 154 further includes respective front and back fold lines 188, 190 having a plurality of front fold portions 192 and back fold portions 194 extending outwardly therefrom along the longitudinal length of top pocket panel 154. Back fold portions 194 are configured to pass between inner surface 120*a* of back wall 120 and first lateral strap 160 while front fold portions 192 are configured to pass between inner surface 124*b'* of fixed portion 124*b* of front wall 124 and second lateral strap 162. Each fold portion 184, 186, 192, 194 may include one half 182*a* of a fastener 180 pair, with the corresponding second half 182*b* being suitably mounted on top pocket panel 154 whereby securing of the fastener halves 182*a*/182*b* (with their respective mounting members 134', 134" and lateral straps 160, 162 encircled therein) removably mounts top pocket panel 154 within bag 110.

As further shown in FIGS. 12, top face 154*a* of top pock panel 154 may not include any mounting members (such as or similar to mounting members 134) thereon. However, as bottom face 154*b* of top pocket panel 154 is directed inwardly toward lower compartment 158 of inner compartment 122, bottom face 154*b* may include a plurality of mounting members 196 thereon. In one aspect, the nominal spacing between success mounting members 196 is substantially the same as spaced distance S of mounting members 134 (and thus width W of central wall portion 166 or sub-portions 166*l*, 166*r*, 166*m* as described above).

Returning now to FIG. 4, in one aspect of the invention, divider panel 150 may similarly include left fold line 198*a* and right side fold line (not shown), as well as a bottom fold line 198*b*. A plurality of fold portions 200 may extend outwardly from fold lines 198*a*, 198*b*, 198*c*, wherein each fold portion 200 is configured to engage and encircle a respective mounting member 134 on inner wall surfaces 116*a*, 118*a*, 114*a* of first side wall 116, second side wall 118 and bottom wall 114, respectively. Securing of fasteners 180 secures divider panel 150 within bag 110 as described above.

This disclosure has been described in detail with particular reference to an embodiment, but it will be understood that variations and modifications can be effected within the spirit and scope of the disclosure. The presently disclosed embodiments are therefore considered in all respects to be illustrative and not restrictive. It should also be understood that all spatial references, such as horizontal, vertical, top, bottom, left and right, front and back, are for explanatory purposes only and may vary depending upon the embodiment. For example, the references "top" and "bottom" are relative and are used only in the context of the other. Reorienting an embodiment may subsequently rearrange the relative spatial positions of "top" and "bottom" within that embodiment. The scope of the invention is indicated by the appended claims, and all changes that come within the meaning and range of equivalents thereof are intended to be embraced therein.

What is claimed is:

1. A bag system comprising:

a) a bag including a top wall, a bottom wall opposing the top wall, a first side wall and a second side wall opposing the first side wall, and a back wall attached to each of the top wall, the bottom wall, the first side wall and the second side wall to define an inner compartment, wherein the bag further includes a front wall having a front wall portion adapted to selectively open and close the inner compartment;

b) a first set of straps secured to an interior surface of the first side wall;

c) a second set of straps secured to an interior surface of the second side wall, wherein the second set of straps correspondingly opposes the first set of straps;

d) a first panel having a first end and an opposing second end, wherein a first fold line is located proximate the first end to define a first fold portion between the first end and the first fold line, wherein a second fold line is located proximate the second end to define a second fold portion between the second end and the second fold line, and wherein a panel portion is defined between the first fold line and the second fold line, wherein the first panel is configured to be received within the inner compartment, wherein the panel portion extends between the interior surface of the first side wall and the interior surface of the second side wall, wherein the first fold portion is configured to pass between the interior surface of the first side wall and a respective strap of the first set of straps with the first fold portion being releasably secured to the panel portion, and wherein the second fold portion is configured to pass between the interior surface of the second side wall and a respective strap of the second set of straps opposed to the respective strap of the first set of straps with the second fold portion being releasably secured to the panel portion, and wherein the first panel subdivides the inner compartment into a first subdivided compartment and a second subdivided compartment.

2. The bag system in accordance with claim 1, wherein the first fold portion includes a first half of a first fastener and the panel portion includes a second half of the first fastener, wherein the first half of the first fastener is matingly engaged with the second half of the first fastener to releasably secure the first fold portion to the panel portion, and wherein the second fold portion includes a first half of a second fastener and the panel portion includes a second half of the second fastener, wherein the first half of the second fastener is matingly engaged with the second half of the second fastener to releasably secure the second fold portion to the panel portion.

3. The bag system in accordance with claim 2, wherein each of the first fastener and the second fastener are snaps.

4. The bag system in accordance with claim 1, wherein the panel portion is rigid but flexible.

5. The bag system in accordance with claim 1, further comprising a third set of straps secured to an interior surface of the bottom wall.

6. The bag system in accordance with claim 5, further comprising a fourth set of one or more straps secured to one or both of a top surface and a bottom surface of the panel portion, wherein the fourth set of one or more straps correspondingly opposes the third set of straps.

7. The bag system in accordance with claim 1, wherein each respective strap within the first set of straps is spaced apart from one another an equidistant width and between the top wall and the bottom wall, and wherein each respective strap within the second set of straps is spaced apart from one another the equidistant width and between the top wall and the bottom wall.

8. The bag system in accordance with claim 6, wherein:

a) each respective strap within the first set of straps is spaced apart from one another an equidistant width and between the top wall and the bottom wall;

b) each respective strap within the second set of straps is spaced apart from one another the equidistant width and between the top wall and the bottom wall;

c) each respective strap within the third set of straps is spaced apart from one another the equidistant width and between the first side wall and the second side wall; and d) each respective strap within the fourth set of straps is spaced apart from one another the equidistant width and between the first fold line and the second fold line.

9. The bag system in accordance with claim 7, further comprising a second panel having a first end and an opposing second end, wherein a first fold line is located proximate the first end to define a first fold portion between the first end and the first fold line, wherein a second fold line is located proximate the second end to define a second fold portion between the second end and the second fold line, wherein a panel portion is defined between the first fold line and the second fold line, and wherein the panel portion has a panel width equal to the equidistant width.

10. The bag system in accordance with claim 1, further comprising a top pocket panel, wherein the back wall further includes a first lateral strap proximate the top wall, wherein the front wall further includes a second lateral strap proximate the top wall and not located on the front wall portion, wherein the first lateral strap and the second lateral strap coincide with a respective strap of first set of straps and a respective strap of the second set of straps, wherein the top pocket panel is configured to be releasably secured to each of the first lateral strap, the second lateral strap, the respective strap of first set of straps, and the respective strap of the second set of straps, wherein a top pocket is formed between a top surface of the top pocket panel and the top wall.

11. The bag system in accordance with claim 10, wherein the top wall includes a flap portion which defines a top opening, wherein the flap portion is adapted to selectively open and close to top pocket.

12. The bag system in accordance with claim 10, wherein a bottom surface of the top pocket panel includes a fifth set of straps, wherein each respective strap within the fifth set of straps is spaced apart from one another the equidistant width and between the first side wall and the second side wall.

* * * * *